US007710051B2

(12) United States Patent
Caporaso et al.

(10) Patent No.: US 7,710,051 B2
(45) Date of Patent: May 4, 2010

(54) COMPACT ACCELERATOR FOR MEDICAL THERAPY

(75) Inventors: George J. Caporaso, Livermore, CA (US); Yu-Jiuan Chen, Fremont, CA (US); Steven A. Hawkins, Livermore, CA (US); Stephen E. Sampayan, Manteca, CA (US); Arthur C. Paul, Walnut Creek, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 703 days.

(21) Appl. No.: 11/586,378

(22) Filed: Oct. 24, 2006

(65) Prior Publication Data

US 2010/0060207 A1 Mar. 11, 2010

Related U.S. Application Data

(63) Continuation-in-part of application No. 11/036,431, filed on Jan. 14, 2005, now Pat. No. 7,173,385.

(60) Provisional application No. 60/536,943, filed on Jan. 15, 2004, provisional application No. 60/730,129, filed on Oct. 24, 2005, provisional application No. 60/730,138, filed on Oct. 24, 2005, provisional application No. 60/730,161, filed on Oct. 24, 2005, provisional application No. 60/798,016, filed on May 4, 2006.

(51) Int. Cl.
*H05H 9/00* (2006.01)

(52) U.S. Cl. ..... 315/505; 315/500; 315/507

(58) Field of Classification Search ..... 315/500, 315/505, 507, 5.41, 5.42, 111.61
See application file for complete search history.

(56) References Cited

U.S. PATENT DOCUMENTS

| | | | | |
|---|---|---|---|---|
| 2,465,840 | A * | 3/1949 | Walker | 333/20 |
| 4,112,306 | A | 9/1978 | Nunan | |
| 4,507,616 | A | 3/1985 | Blosser et al. | |
| 4,570,106 | A | 2/1986 | Sohval et al. | |
| 4,870,287 | A | 9/1989 | Cole et al. | |
| 4,888,556 | A * | 12/1989 | Buttram et al. | 315/505 |
| 5,107,839 | A | 4/1992 | Houdek et al. | |

(Continued)

FOREIGN PATENT DOCUMENTS

WO WO 2004/109171 12/2004

(Continued)

OTHER PUBLICATIONS

Sampayan et al. "Development of a compact radiography accelerator using dielectric wall accelerator technology" Pulsed Power Conference, pp. 50-53, Jun. 2005.

*Primary Examiner*—Douglas W Owens
*Assistant Examiner*—Jimmy T Vu
(74) *Attorney, Agent, or Firm*—James S. Tak

(57) ABSTRACT

A compact accelerator system having an integrated particle generator-linear accelerator with a compact, small-scale construction capable of producing an energetic (~70-250 MeV) proton beam or other nuclei and transporting the beam direction to a medical therapy patient without the need for bending magnets or other hardware often required for remote beam transport. The integrated particle generator-accelerator is actuable as a unitary body on a support structure to enable scanning of a particle beam by direction actuation of the particle generator-accelerator.

29 Claims, 14 Drawing Sheets

U.S. PATENT DOCUMENTS

| | | | | |
|---|---|---|---|---|
| 5,427,097 | A | 6/1995 | Depp | |
| 5,727,042 | A | 3/1998 | Brenneisen | |
| 5,757,146 | A * | 5/1998 | Carder | 315/505 |
| 5,811,944 | A | 9/1998 | Sampayan et al. | |
| 5,821,705 | A * | 10/1998 | Caporaso et al. | 315/507 |
| 6,278,239 | B1 | 8/2001 | Caporaso et al. | |
| 6,331,194 | B1 | 12/2001 | Sampayan et al. | |
| 6,486,478 | B1 | 11/2002 | Libby et al. | |
| 6,635,882 | B1 | 10/2003 | Pavlovic et al. | |
| 6,683,318 | B1 | 1/2004 | Haberer et al. | |
| 6,759,807 | B2 | 7/2004 | Wahlin | |
| 6,814,694 | B1 | 11/2004 | Pedroni | |
| 6,985,553 | B2 | 1/2006 | Leung et al. | |
| 2004/0134311 | A1 * | 7/2004 | Bruske | 75/335 |
| 2005/0089141 | A1 | 4/2005 | Brown | |

FOREIGN PATENT DOCUMENTS

| | | |
|---|---|---|
| WO | WO 2005/057738 | 6/2005 |

* cited by examiner

COMPACT ACCELERATOR FOR MEDICAL THERAPY

I. REFERENCE TO PRIOR APPLICATIONS

This application is a continuation-in-part of prior application Ser. No. 11/036,431, filed Jan. 14, 2005, which claims the benefit of Provisional Application No. 60/536,943, filed Jan. 15, 2004; and this application also claims the benefit of U.S. Provisional Application Nos. 60/730,128, 60/730,129, and 60/730,161, filed Oct. 24, 2005, and U.S. Provisional Application No. 60/798,016, filed May 4, 2006, all of which are incorporated by reference herein.

The United States Government has rights in this invention pursuant to Contract No. W-7405-ENG-48 between the United States Department of Energy and the University of California for the operation of Lawrence Livermore National Laboratory.

II. FIELD OF THE INVENTION

The present invention relates to linear accelerators and more particularly to compact dielectric wall accelerators and pulse-forming lines that operate at high gradients to feed an accelerating pulse down an insulating wall, with a charged particle generator integrated on the accelerator to enable compact unitary actuation.

III. BACKGROUND OF THE INVENTION

Particle accelerators are used to increase the energy of electrically-charged atomic particles, e.g., electrons, protons, or charged atomic nuclei, so that they can be studied by nuclear and particle physicists. High energy electrically-charged atomic particles are accelerated to collide with target atoms, and the resulting products are observed with a detector. At very high energies the charged particles can break up the nuclei of the target atoms and interact with other particles. Transformations are produced that tip off the nature and behavior of fundamental units of matter. Particle accelerators are also important tools in the effort to develop nuclear fusion devices, as well as for medical applications such as cancer therapy.

One type of particle accelerator is disclosed in U.S. Pat. No. 5,757,146 to Carder, incorporated by reference herein, for providing a method to generate a fast electrical pulse for the acceleration of charged particles. In Carder, a dielectric wall accelerator (DWA) system is shown consisting of a series of stacked circular modules which generate a high voltage when switched. Each of these modules is called an asymmetric Blumlein, which is described in U.S. Pat. No. 2,465,840 incorporated by reference herein. As can be best seen in FIGS. 4A-4B of the Carder patent, the Blumlein is composed of two different dielectric layers. On each surface and between the dielectric layers are conductors which form two parallel plate radial transmission lines. One side of the structure is referred to as the slow line, the other is the fast line. The center electrode between the fast and slow line is initially charged to a high potential. Because the two lines have opposite polarities there is no net voltage across the inner diameter (ID) of the Blumlein. Upon applying a short circuit across the outside of the structure by a surface flashover or similar switch, two reverse polarity waves are initiated which propagate radially inward towards the ID of the Blumlein. The wave in the fast line reaches the ID of the structure prior to the arrival of the wave in the slow line. When the fast wave arrives at the ID of the structure, the polarity there is reversed in that line only, resulting in a net voltage across the ID of the asymmetric Blumlein. This high voltage will persist until the wave in the slow line finally reaches the ID. In the case of an accelerator, a charged particle beam can be injected and accelerated during this time. In this manner, the DWA accelerator in the Carder patent provides an axial accelerating field that continues over the entire structure in order to achieve high acceleration gradients.

The existing dielectric wall accelerators, such as the Carder DWA, however, have certain inherent problems which can affect beam quality and performance. In particular, several problems exist in the disc-shaped geometry of the Carder DWA which make the overall device less than optimum for the intended use of accelerating charged particles. The flat planar conductor with a central hole forces the propagating wavefront to radially converge to that central hole. In such a geometry, the wavefront sees a varying impedance which can distort the output pulse, and prevent a defined time dependent energy gain from being imparted to a charged particle beam traversing the electric field. Instead, a charged particle beam traversing the electric field created by such a structure will receive a time varying energy gain, which can prevent an accelerator system from properly transporting such beam, and making such beams of limited use.

Additionally, the impedance of such a structure may be far lower than required. For instance, it is often highly desirable to generate a beam on the order of milliamps or less while maintaining the required acceleration gradients. The disc-shaped Blumlein structure of Carder can cause excessive levels of electrical energy to be stored in the system. Beyond the obvious electrical inefficiencies, any energy which is not delivered to the beam when the system is initiated can remain in the structure. Such excess energy can have a detrimental effect on the performance and reliability of the overall device, which can lead to premature failure of the system.

And inherent in a flat planar conductor with a central hole (e.g. disc-shaped) is the greatly extended circumference of the exterior of that electrode. As a result, the number of parallel switches to initiate the structure is determined by that circumference. For example, in a 6" diameter device used for producing less than a 10 ns pulse typically requires, at a minimum, 10 switch sites per disc-shaped asymmetric Blumlein layer. This problem is further compounded when long acceleration pulses are required since the output pulse length of this disc-shaped Blumlein structure is directly related to the radial extent from the central hole. Thus, as long pulse widths are required, a corresponding increase in switch sites is also required. As the preferred embodiment of initiating the switch is the use of a laser or other similar device, a highly complex distribution system is required. Moreover, a long pulse structure requires large dielectric sheets for which fabrication is difficult. This can also increase the weight of such a structure. For instance, in the present configuration, a device delivering 50 ns pulse can weigh as much as several tons per meter. While some of the long pulse disadvantages can be alleviated by the use of spiral grooves in all three of the conductors in the asymmetric Blumlein, this can result in a destructive interference layer-to-layer coupling which can inhibit the operation. That is, a significantly reduced pulse amplitude (and therefore energy) per stage can appear on the output of the structure.

Additionally, various types of accelerators have been developed for particular use in medical therapy applications, such as cancer therapy using proton beams. For example, U.S. Pat. No. 4,879,287 to Cole et al discloses a multi-station proton beam therapy system used for the Loma Linda University Proton Accelerator Facility in Loma Linda, California. In this system, particle source generation is performed at one location of the facility, acceleration is performed at another location of the facility, while patients are located at still other locations of the facility. Due to the remoteness of the source, acceleration, and target from each other particle transport is accomplished using a complex gantry system with large, bulky bending magnets. And other representative systems known for medical therapy are disclosed in U.S. Pat. No. 6,407,505 to Bertsche and U.S. Pat. No. 4,507,616 to Blosser et al. In Berstche, a standing wave RF linac is shown and in Blosser a superconducting cyclotron rotatably mounted on a support structure is shown.

Furthermore, ion sources are known which create a plasma discharge from a low pressure gas within a volume. From this volume, ions are extracted and collimated for acceleration into an accelerator. These systems are generally limited to extracted current densities of below 0.25 A/cm2. This low current density is partially due to the intensity of the plasma discharge at the extraction interface. One example of an ion source known in the art is disclosed in U.S. Pat. No. 6,985,553 to Leung et al having an extraction system configured to produce ultra-short ion pulses. Another example is shown in U.S. Pat. No. 6,759,807 to Wahlin disclosing a multi-grid ion beam source having an extraction grid, an acceleration grid, a focus grid, and a shield grid to produce a highly collimated ion beam.

IV. SUMMARY OF THE INVENTION

One aspect of the present invention includes a compact accelerator system comprising: a support structure; an integrated particle generator-accelerator actuably mounted on the support structure, comprising: a compact linear accelerator having at least one transmission line(s) extending toward a transverse acceleration axis; and a charged particle generator connected to the compact linear accelerator for producing and injecting a charged particle beam into the compact linear accelerator along the acceleration axis; switch means connectable to a high voltage potential for propagating at least one electrical wavefront(s) through the transmission line(s) of the compact linear accelerator to impress a pulsed gradient along the acceleration axis which imparts energy to the injected beam; and means for actuating the integrated particle generator-accelerator to control the pointing direction of the energized beam and the position of the beamspot produced thereby.

Another aspect of the present invention includes a charged particle generator comprising: a pulsed ion source having at least two electrodes bridged by a bridging material selected from the group consisting of insulating, semi-insulating, and semi-conductive materials, and a source material having a desired ion species in atomic or molecular form located adjacent at least one of the electrodes.

V. BRIEF DESCRIPTION OF THE DRAWINGS

The accompanying drawings, which are incorporated into and form a part of the disclosure, are as follows.

VI. DETAILED DESCRIPTION

A. Compact Accelerator with Strip-shaped Blumlein

Turning now to the drawings, FIGS. 1-12 show a compact linear accelerator used in the present invention, having at least one strip-shaped Blumlein module which guides a propagating wavefront between first and second ends and controls the output pulse at the second end. Each Blumlein module has first, second, and third planar conductor strips, with a first dielectric strip between the first and second conductor strips, and a second dielectric strip between the second and third conductor strips. Additionally, the compact linear accelerator includes a high voltage power supply connected to charge the second conductor strip to a high potential, and a switch for switching the high potential in the second conductor strip to at least one of the first and third conductor strips so as to initiate a propagating reverse polarity wavefront(s) in the corresponding dielectric strip(s).

The compact linear accelerator has at least one strip-shaped Blumlein module which guides a propagating wavefront between first and second ends and controls the output pulse at the second end. Each Blumlein module has first, second, and third planar conductor strips, with a first dielectric strip between the first and second conductor strips, and a second dielectric strip between the second and third conductor strips. Additionally, the compact linear accelerator includes a high voltage power supply connected to charge the second conductor strip to a high potential, and a switch for switching the high potential in the second conductor strip to at least one of the first and third conductor strips so as to initiate a propagating reverse polarity wavefront(s) in the corresponding dielectric strip(s).

Figure 1:
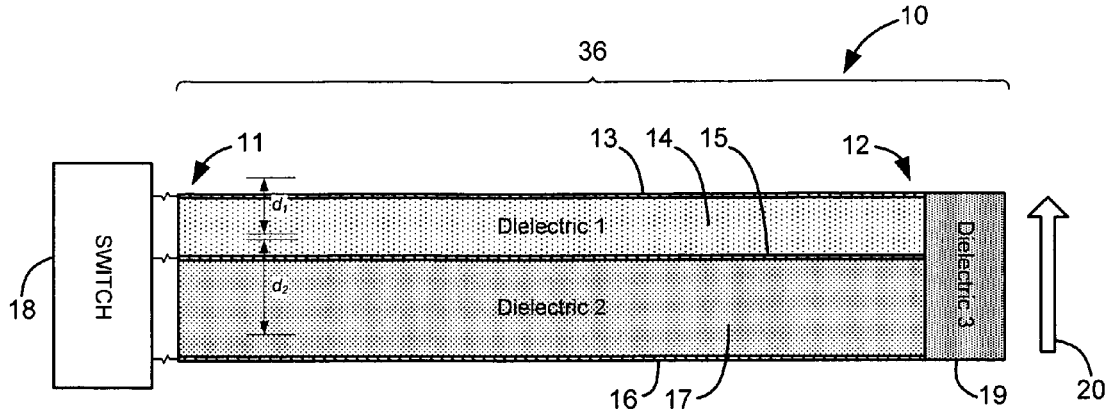
FIG. 1 is a side view of a first exemplary embodiment of a single Blumlein module of the compact accelerator of the present invention.
Figure 2:
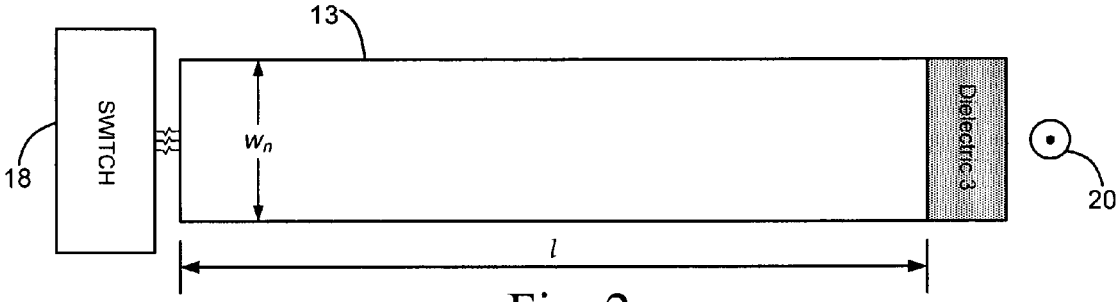
FIG. 2 is top view of the single Blumlein module of FIG. 1.
Figure 6:
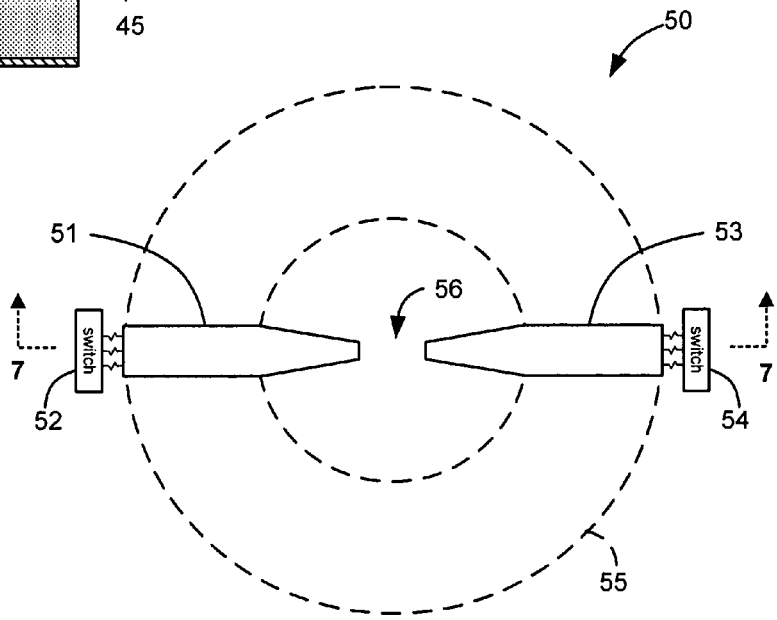
FIG. 6 is a plan view of another exemplary embodiment of the compact accelerator shown with two Blumlein modules perimetrically surrounding and radially extending towards a central acceleration region.
Figure 7:
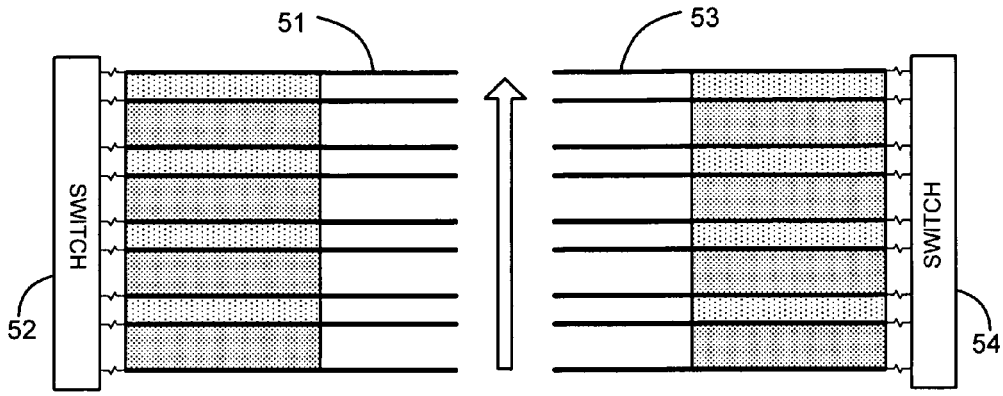
FIG. 7 is a cross-sectional view taken along line 7 of FIG. 6.

FIGS. 1-2 show a first exemplary embodiment of the compact linear accelerator, generally indicated at reference character 10, and comprising a single Blumlein module 36 connected to a switch 18. The compact accelerator also includes a suitable high voltage supply (not shown) providing a high voltage potential to the Blumlein module 36 via the switch 18. Generally, the Blumlein module has a strip configuration, i.e. a long narrow geometry, typically of uniform width but not necessarily so. The particular Blumlein module 11 shown in FIGS. 1 and 2 has an elongated beam or plank-like linear configuration extending between a first end 11 and a second end 12, and having a relatively narrow width, $w_n$ (FIGS. 2, 4) compared to the length, l. This strip-shaped configuration of the Blumlein module operates to guide a propagating electrical signal wave from the first end 11 to the second end 12, and thereby control the output pulse at the second end. In particular, the shape of the wavefront may be controlled by suitably configuring the width of the module, e.g. by tapering the width as shown in FIG. 6. The strip-shaped configuration enables the compact accelerator to overcome the varying impedance of propagating wavefronts which can occur when radially directed to converge upon a central hole as discussed in the Background regarding disc-shaped module of Carder. And in this manner, a flat output (voltage) pulse can be produced by the strip or beam-like configuration of the module 10 without distorting the pulse, and thereby prevent a particle beam from receiving a time varying energy gain. As used herein and in the claims, the first end 11 is characterized as that end which is connected to a switch, e.g. switch 18, and the second end 12 is that end adjacent a load region, such as an output pulse region for particle acceleration.

As shown in FIGS. 1 and 2, the narrow beam-like structure of the basic Blumlein module 10 includes three planar conductors shaped into thin strips and separated by dielectric material also shown as elongated but thicker strips. In particular, a first planar conductor strip 13 and a middle second planar conductor strip 15 are separated by a first dielectric material 14 which fills the space therebetween. And the second planar conductor strip 15 and a third planar conductor strip 16 are separated by a second dielectric material 17 which fills the space therebetween. Preferably, the separation produced by the dielectric materials positions the planar conductor strips 13, 15 and 16 to be parallel with each other as shown. A third dielectric material 19 is also shown connected to and capping the planar conductor strips and dielectric strips 13-17. The third dielectric material 19 serves to combine the waves and allow only a pulsed voltage to be across the vacuum wall, thus reducing the time the stress is applied to that wall and enabling even higher gradients. It can also be used as a region to transform the wave, i.e., step up the voltage, change the impedance, etc. prior to applying it to the accelerator. As such, the third dielectric material 19 and the second end 12 generally, are shown adjacent a load region indicated by arrow 20. In particular, arrow 20 represents an acceleration axis of a particle accelerator and pointing in the direction of particle acceleration. It is appreciated that the direction of acceleration is dependent on the paths of the fast and slow transmission lines, through the two dielectric strips, as discussed in the Background.

Figure 12:
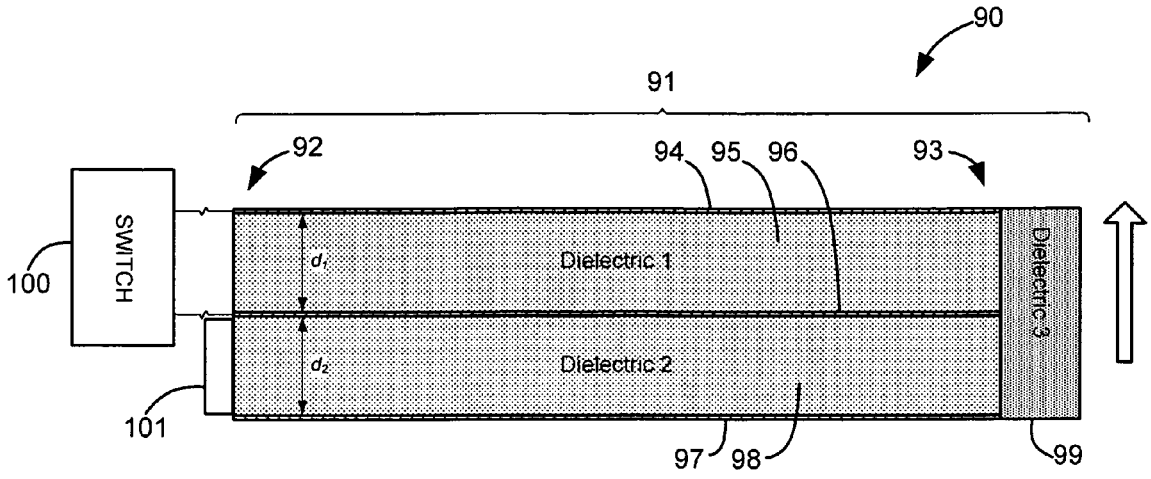
FIG. 12 is a side view of another exemplary embodiment of the present invention similar to FIG. 1, and having the first dielectric strip and the second dielectric strip having the same dielectric constants and the same thicknesses, for symmetric Blumlein operation.

In FIG. 1, the switch 18 is shown connected to the planar conductor strips 13, 15, and 16 at the respective first ends, i.e. at first end 11 of the module 36. The switch serves to initially connect the outer planar conductor strips 13, 16 to a ground potential and the middle conductor strip 15 to a high voltage source (not shown). The switch 18 is then operated to apply a short circuit at the first end so as to initiate a propagating voltage wavefront through the Blumlein module and produce an output pulse at the second end. In particular, the switch 18 can initiate a propagating reverse polarity wavefront in at least one of the dielectrics from the first end to the second end, depending on whether the Blumlein module is configured for symmetric or asymmetric operation. When configured for asymmetric operation, as shown in FIGS. 1 and 2, the Blumlein module comprises different dielectric constants and thicknesses ($d_1 \neq d_2$) for the dielectric layers 14, 17, in a manner similar to that described in Carder. The asymmetric operation of the Blumlein generates different propagating wave velocities through the dielectric layers. However, when the Blumlein module is configured for symmetric operation as shown in FIG. 12, the dielectric strips 95, 98 are of the same dielectric constant, and the width and thickness ($d_1 = d_2$) are also the same. In addition, as shown in FIG. 12, a magnetic material is also placed in close proximity to the second dielectric strip 98 such that propagation of the wavefront is inhibited in that strip. In this manner, the switch is adapted to initiate a propagating reverse polarity wavefront in only the first dielectric strip 95. It is appreciated that the switch 18 is a suitable switch for asymmetric or symmetric Blumlein module operation, such as for example, gas discharge closing switches, surface flashover closing switches, solid state switches, photoconductive switches, etc. And it is further appreciated that the choice of switch and dielectric material types/dimensions can be suitably chosen to enable the compact accelerator to operate at various acceleration gradients, including for example gradients in excess of twenty megavolts per meter. However, lower gradients would also be achievable as a matter of design.

In one preferred embodiment, the second planar conductor has a width, $w_1$ defined by characteristic impedance $Z_1=k_1g_1(w_1,d_1)$ through the first dielectric strip. $k_1$ is the first electrical constant of the first dielectric strip defined by the square root of the ratio of permeability to permittivity of the first dielectric material, $g_1$ is the function defined by the geometry effects of the neighboring conductors, and $d_1$ is the thickness of the first dielectric strip. And the second dielectric strip has a thickness defined by characteristic impedance $Z_2=k_2g_2(w_2, d_2)$ through the second dielectric strip. In this case, $k_2$ is the second electrical constant of the second dielectric material, $g_2$ is the function defined by the geometry effects of the neighboring conductors, and $w_2$ is the width of the second planar conductor strip, and $d_2$ is the thickness of the second dielectric strip. In this manner, as differing dielectrics required in the asymmetric Blumlein module result in differing impedances, the impedance can now be hold constant by adjusting the width of the associated line. Thus greater energy transfer to the load will result.

Figure 4:
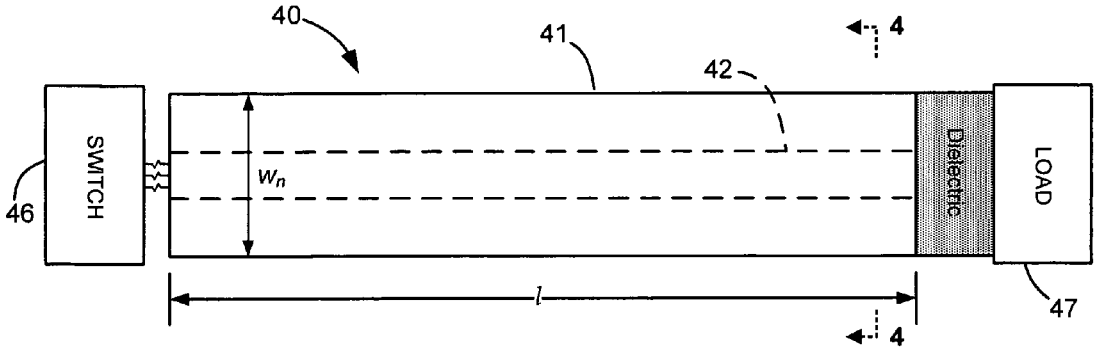
FIG. 4 is a top view of a third exemplary embodiment of a single Blumlein module of the present invention having a middle conductor strip with a smaller width than other layers of the module.
Figure 5:
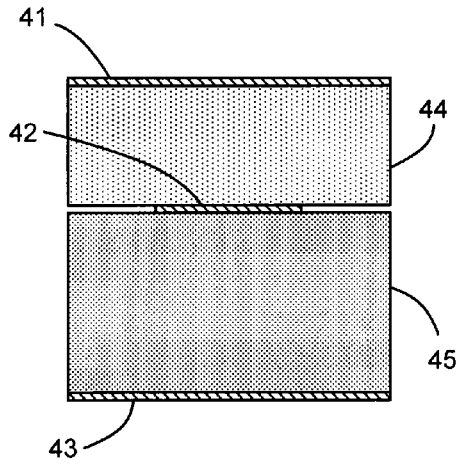
FIG. 5 is an enlarged cross-sectional view taken along line 4 of FIG. 4.

FIGS. 4 and 5 show an exemplary embodiment of the Blumlein module having a second planar conductor strip 42 with a width that is narrower than those of the first and second planar conductor strips 41, 42, as well as first and second dielectric strips 44, 45. In this particular configuration, the destructive interference layer-to-layer coupling discussed in the Background is inhibited by the extension of electrodes 41 and 43 as electrode 42 can no longer easily couple energy to the previous or subsequent Blumlein. Furthermore, another exemplary embodiment of the module preferably has a width which varies along the lengthwise direction, l, (see FIGS. 2, 4) so as to control and shape the output pulse shape. This is shown in FIG. 6 showing a tapering of the width as the module extends radially inward towards the central load region. And in another preferred embodiment, dielectric materials and dimensions of the Blumlein module are selected such that, $Z_1$ is substantially equal to $Z_2$. As previously discussed, match impedances prevent the formation of waves which would create an oscillatory output.

And preferably, in the asymmetric Blumlein configuration, the second dielectric strip 17 has a substantially lesser propagation velocity than the first dielectric strip 14, such as for example 3:1, where the propagation velocities are defined by $v_2$, and $v_1$, respectively, where $v_2=(\mu_2\in_2)^{-0.5}$ and $v_1=(\mu_1\in_1)^{-0.5}$; the permeability, $\mu_1$, and the permittivity, $\in_1$, are the material constants of the first dielectric material; and the permeability, $\mu_2$, and the permittivity, $\in_2$, are the material constants of the second dielectric material. This can be achieved by selecting for the second dielectric strip a material having a dielectric constant, i.e. $\mu_1\in_1$, which is greater than the dielectric constant of the first dielectric strip, i.e. $\mu_2\in_2$. As shown in FIG. 1, for example, the thickness of the first dielectric strip is indicated as $d_1$, and the thickness of the second dielectric strip is indicated as $d_2$, with $d_2$ shown as being greater than $d_1$. By setting $d_2$ greater than $d_1$, the combination of different spacing and the different dielectric constants results in the same characteristic impedance, Z, on both sides of the second planar conductor strip 15. It is notable that although the characteristic impedance may be the same on both halves, the propagation velocity of signals through each half is not necessarily the same. While the dielectric constants and the thicknesses of the dielectric strips may be suitably chosen to effect different propagating velocities, it is appreciated that the elongated strip-shaped structure and configuration need not utilize the asymmetric Blumlein concept, i.e. dielectrics having different dielectric constants and thicknesses. Since the controlled waveform advantages are made possible by the elongated beam-like geometry and configuration of the Blumlein modules, and not by the particular method of producing the high acceleration gradient, another exemplary embodiment can employ alternative switching arrangements, such as that discussed for FIG. 12 involving symmetric Blumlein operation.

Figure 3:
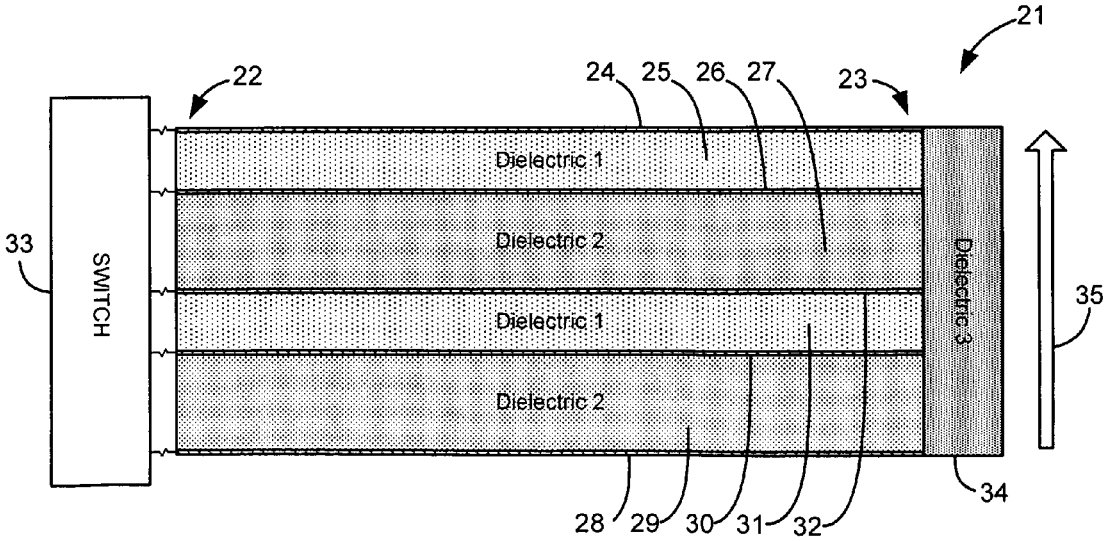
FIG. 3 is a side view of a second exemplary embodiment of the compact accelerator having two Blumlein modules stacked together.

The compact accelerator may alternatively be configured to have two or more of the elongated Blumlein modules stacked in alignment with each other. For example, FIG. 3 shows a compact accelerator 21 having two Blumlein modules stacked together in alignment with each other. The two Blumlein modules form an alternating stack of planar conductor strips and dielectric strips 24-32, with the planar conductor strip 32 common to both modules. And the conductor strips are connected at a first end 22 of the stacked module to a switch 33. A dielectric wall is also provided at 34 capping the second end 23 of the stacked module, and adjacent a load region indicated by acceleration axis arrow 35.

The compact accelerator may also be configured with at least two Blumlein modules which are positioned to perimetrically surround a central load region. Furthermore, each perimetrically surrounding module may additionally include one or more additional Blumlein modules stacked to align with the first module. FIG. 6, for example, shows an exemplary embodiment of a compact accelerator 50 having two Blumlein module stacks 51 and 53, with the two stacks surrounding a central load region 56. Each module stack is shown as a stack of four independently operated Blumlein modules (FIG. 7), and is separately connected to associated switches 52, 54. It is appreciated that the stacking of Blumlein modules in alignment with each other increases the coverage of segments along the acceleration axis.

Figure 8:
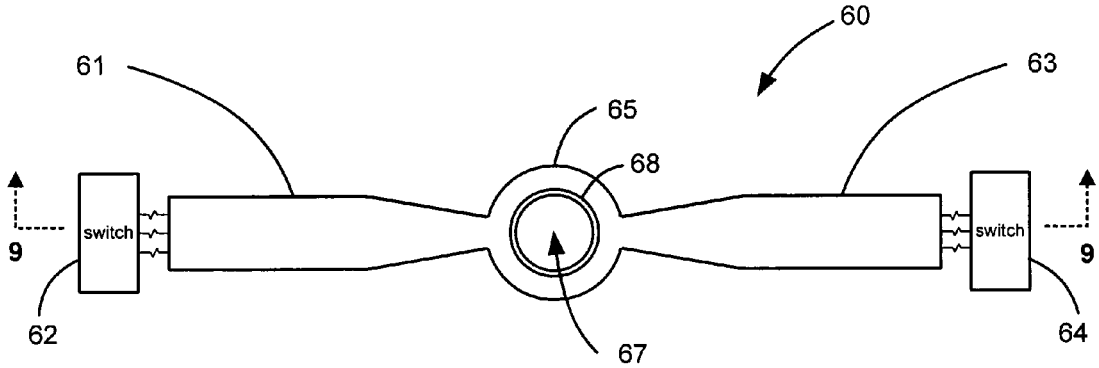
FIG. 8 is a plan view of another exemplary embodiment of the compact accelerator shown with two Blumlein modules perimetrically surrounding and radially extending towards a central acceleration region, with planar conductor strips of one module connected by ring electrodes to corresponding planar conductor strips of the other module.
Figure 9:
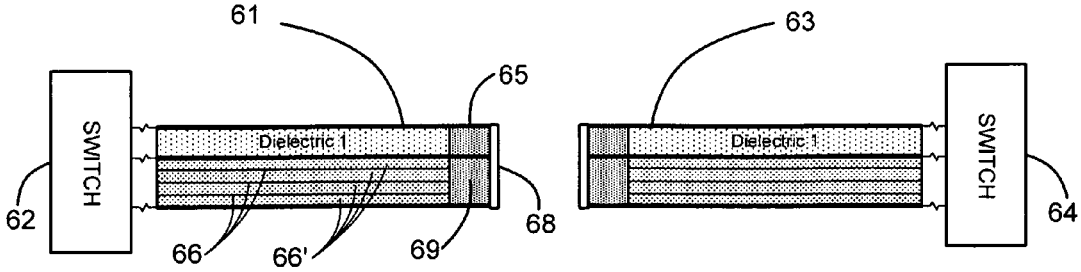
FIG. 9 is a cross-sectional view taken along line 9 of FIG. 8.

In FIGS. 8 and 9 another exemplary embodiment of a compact accelerator is shown at reference character 60, having two or more conductor strips, e.g. 61, 63, connected at their respective second ends by a ring electrode indicated at 65. The ring electrode configuration operates to overcome any azimuthal averaging which may occur in the arrangement of such as FIGS. 6 and 7 where one or more perimetrically surrounding modules extend towards the central load region without completely surrounding it. As best seen in FIG. 9, each module stack represented by 61 and 62 is connected to an associated switch 62 and 64, respectively. Furthermore, FIGS. 8 and 9 show an insulator sleeve 68 placed along an interior diameter of the ring electrode. Alternatively, separate insulator material 69 is also shown placed between the ring electrodes 65. And as an alternative to the dielectric material used between the conductor strips, alternating layers of conducting 66 and insulating 66' foils may be utilized. The alternative layers may be formed as a laminated structure in lieu of a monolithic dielectric strip.

Figure 10:
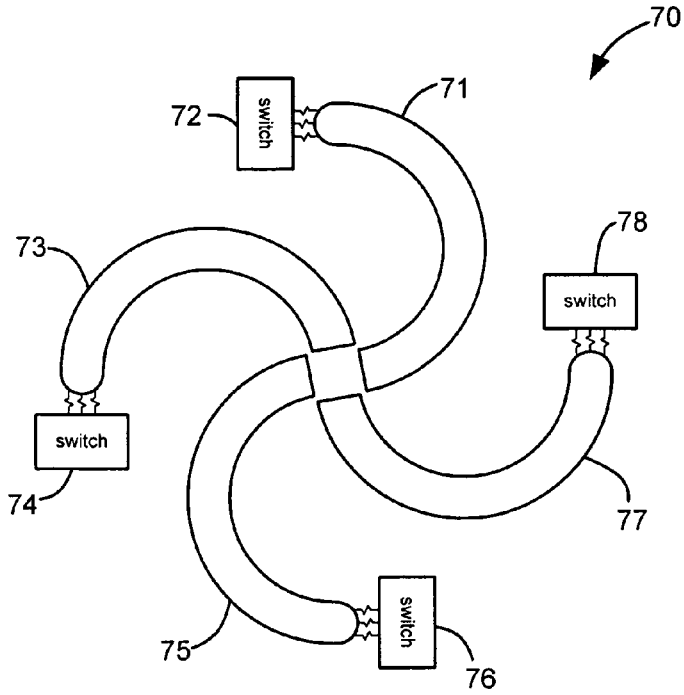
FIG. 10 is a plan view of another exemplary embodiment of the present invention having four non-linear Blumlein modules each connected to an associated switch.
Figure 11:
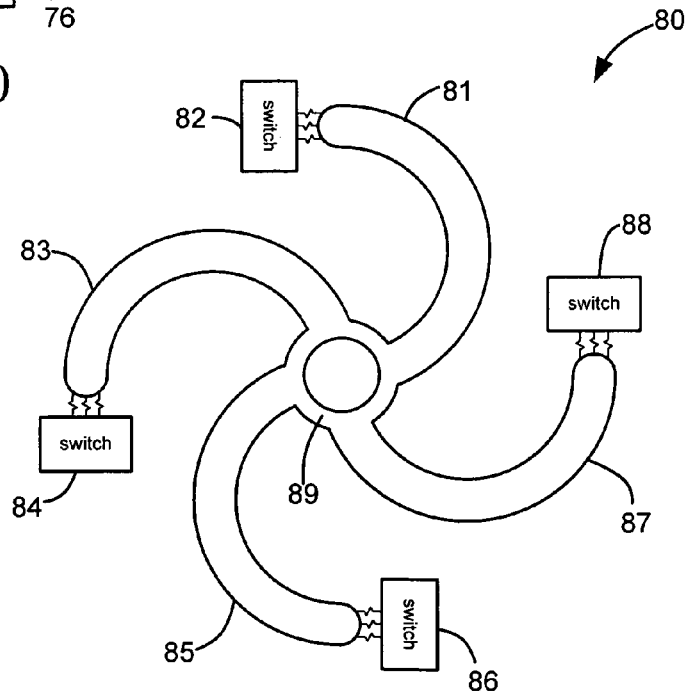
FIG. 11 is a plan view of another exemplary embodiment of the present invention similar to FIG. 10, and including a ring electrode connecting each of the four non-linear Blumlein modules at respective second ends thereof.

And FIGS. 10 and 11 show two additional exemplary embodiments of the compact accelerator, generally indicated at reference character 70 in FIG. 10, and reference character 80 in FIG. 11, each having Blumlein modules with non-linear strip-shaped configurations. In this case, the non-linear strip-shaped configuration is shown as a curvilinear or serpentine form. In FIG. 10, the accelerator 70 comprises four modules 71, 73, 75, and 77, shown perimetrically surrounding and extending towards a central region. Each module 71, 73, 75, and 77, is connected to an associated switch, 72, 74, 76, and 78, respectively. As can be seen from this arrangement, the direct radial distance between the first and second ends of each module is less than the total length of the non-linear module, which enables compactness of the accelerator while increasing the electrical transmission path. FIG. 11 shows a similar arrangement as in FIG. 10, with the accelerator 80 having four modules 81, 83, 85, and 87, shown perimetrically surrounding and extending towards a central region. Each module 81, 83, 85, and 87, is connected to an associated switch, 82, 84, 86, and 88, respectively. Furthermore, the radially inner ends, i.e. the second ends, of the modules are connected to each other by means of a ring electrode 89, providing the advantages discussed in FIG. 8.

B. Sequentially Pulsed Traveling Wave Acceleration Mode

An Induction Linear Accelerator (LIAs), in the quiescent state is shorted along its entire length. Thus, the acceleration of a charged particle relies on the ability of the structure to create a transient electric field gradient and isolate a sequential series of applied acceleration pulse from the adjoining pulse-forming lines. In prior art LIAs, this method is implemented by causing the pulseforming lines to appear as a series of stacked voltage sources from the interior of the structure for a transient time, when preferably, the charge particle beam is present. Typical means for creating this acceleration gradient and providing the required isolation is through the use of magnetic cores within the accelerator and use of the transit time of the pulse-forming lines themselves. The latter includes the added length resulting from any connecting cables. After the acceleration transient has occurred, because of the saturation of the magnetic cores, the system once again appears as a short circuit along its length. The disadvantage of such prior art system is that the acceleration gradient is quite low (~0.2-0.5 MV/m) due to the limited spatial extent of the acceleration region and magnetic material is expensive and bulky. Furthermore, even the best magnetic materials cannot respond to a fast pulse without severe loss of electrical energy, thus if a core is required, to build a high gradient accelerator of this type can be impractical at best, and not technically feasible at worst.

Figure 25:
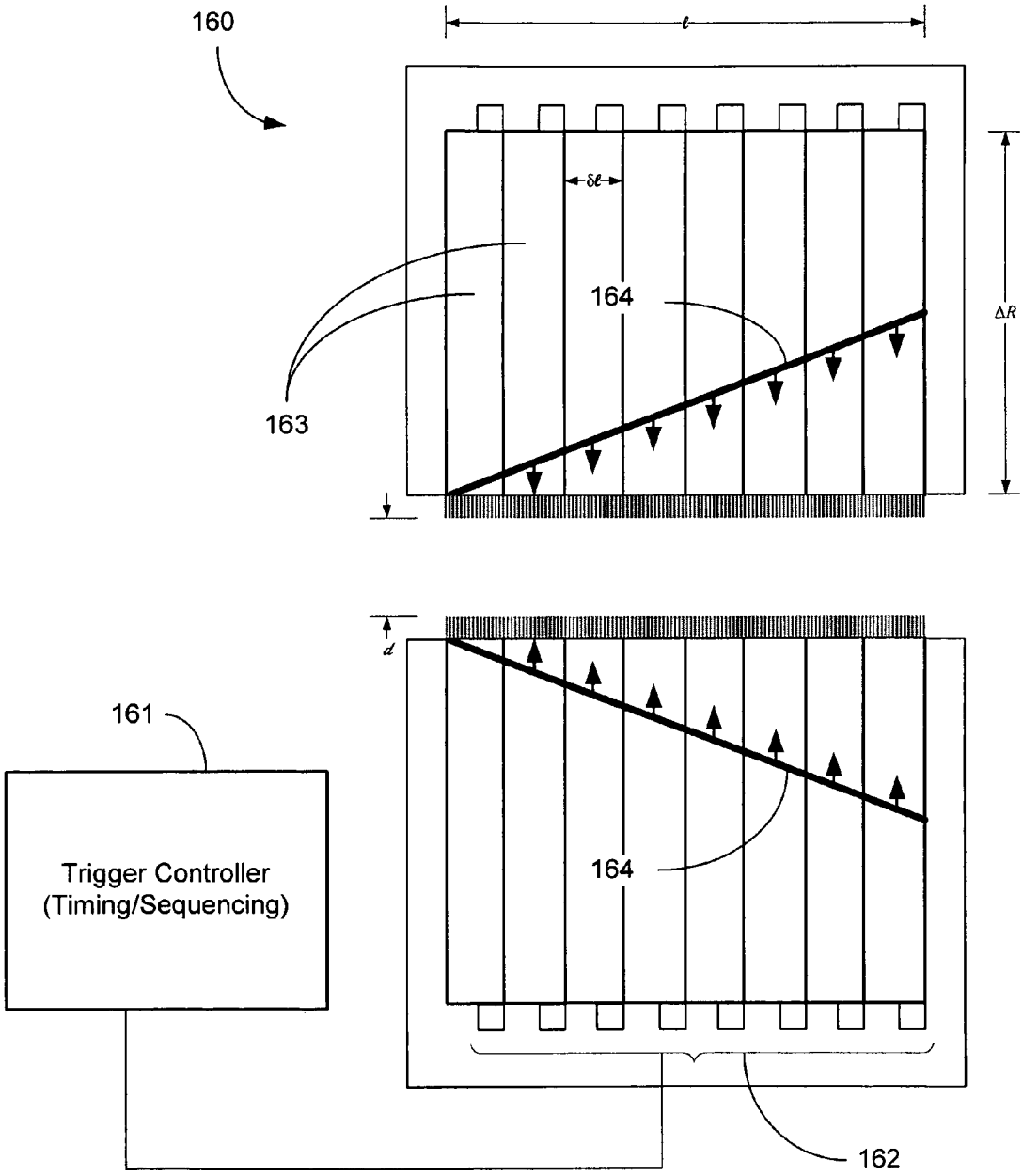
FIG. 25 is a schematic view of a sequentially pulsed traveling wave accelerator of the present invention.

FIG. 25 shows a schematic view of the sequentially pulsed traveling wave accelerator of the present invention, generally indicated at reference character 160 having a length l. Each of the transmission lines of the accelerator is shown having a length ΔR and a width δl, and the beam tube has a diameter d. A trigger controller 161 is provided which sequentially triggers a set of switches 162 to sequentially excite a short axial length δl of the beam tube with an acceleration pulse having electrical length (i.e. pulse width) τ, to produce a single virtual traveling wave 164 along the length of the acceleration axis. In particular, the sequential trigger/controller is capable of sequentially triggering the switches so that a traveling axial electric field is produced along a beam tube surrounding the acceleration axis in synchronism with an axially traversing pulsed beam of charged particles to serially impart energy to the particles. The trigger controller 161 may trigger each of the switches individually. Alternatively, it is capable of simultaneously switching at least two adjacent transmission lines which form a block and sequentially switching adjacent blocks, so that an acceleration pulse is formed through each block. In this manner, blocks of two or more switches/transmission lines excite a short axial length nδl of the beam tube wall. δl is a short axial length of the beam tube wall corresponding to an excited line, and n is the number of adjacent excited lines at any instant of time, with n≧1.

Some example dimensions for illustration purposes: d=8 cm, τ=several nanoseconds (e.g. 1-5 nanoseconds for proton acceleration, 100 picoseconds to few nanoseconds for electron acceleration), v=c/2 where c=speed of light. It is appreciated, however, that the present invention is scalable to virtually any dimension. Preferably, the diameter d and length l of the beam tube satisfy the criteria l>4d , so as to reduce fringe fields at the input and output ends of the dielectric beam tube. Furthermore, the beam tube preferably satisfies the criteria: γτv>d/0.6, where v is the velocity of the wave on the beam tube wall, d is the diameter of the beam tube, τ is the pulse width where $$\tau = \frac{2\Delta R\sqrt{\mu_r \varepsilon_r}}{c},$$

and γ is the Lorentz factor where $$\gamma = \frac{1}{\sqrt{1 - \frac{v^2}{c^2}}}.$$

It is notatable that ΔR is the length of the pulse-forming line, $\mu_r$ is the relative permeability (usually=1), and $\in_r$ is the relative permitivity.) In this manner, the pulsed high gradient produced along the acceleration axis is at least about 30 MeV per meter and up to about 150 MeV per meter.

Unlike most accelerator systems of this type which require a core to create the acceleration gradient, the accelerator system of the present invention operates without a core because if the criteria nδl<1 is satisfied, then the electrical activation of the beam tube occurs along a small section of the beam tube at a given time is kept from shorting out. By not using a core, the present invention avoids the various problems associated with the use of a core, such as the limitation of acceleration since the achievable voltage is limited by ΔB, where Vt $$= A\Delta B,$$

where A is cross-sectional area of core. Use of a core also operates to limit repetition rate of the accelerator because a pulse power source is needed to reset the core. The acceleration pulsed in a given nδl is isolated from the conductive housing due to the transient isolation properties of the un-energized transmission lines neighboring the given axial segment. It is appreciated that a parasitic wave arises from incomplete transient isolation properties of the un-energized transmission lines since some of the switch current is shunted to the unenergized transmission lines. This occurs of course without magnetic core isolation to prevent this shunt from flowing. Under certain conditions, the parasitic wave may be used advantageously, such as illustrated in the following example. In a configuration of an open circuited Blumlein stack consisting of asymmetric strip Blumleins where only the fast/high impedance (low dielectric constant) line is switched, the parasitic wave generated in the un-energized transmission lines will generate a higher voltage on the un-energized lines boosting its voltage over the initial charged state while boosting the voltage on the slow line by a lesser amount. This is because the two lines appear in series as a voltage divider subjected to the same injected current. The wave appearing at the accelerator wall is now boosted to a larger value than initially charged, making a higher acceleration gradient achievable.

Figure 26:
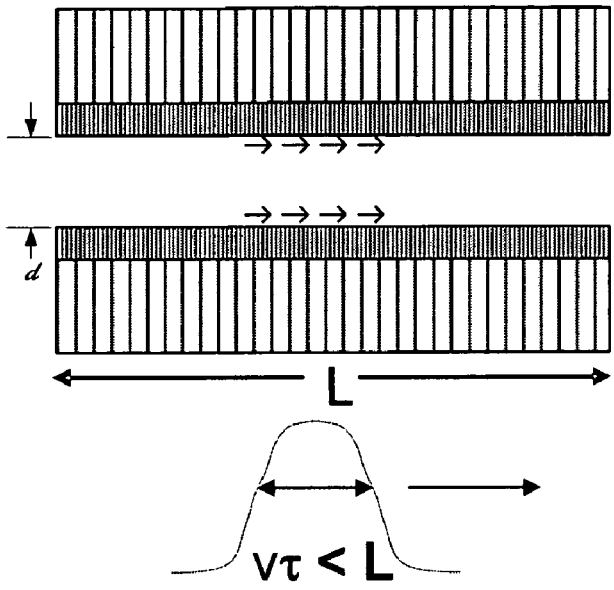
FIG. 26 is a schematic view illustrating a short pulse traveling wave operation of the sequentially pulsed traveling wave accelerator of FIG. 25.
Figure 27:
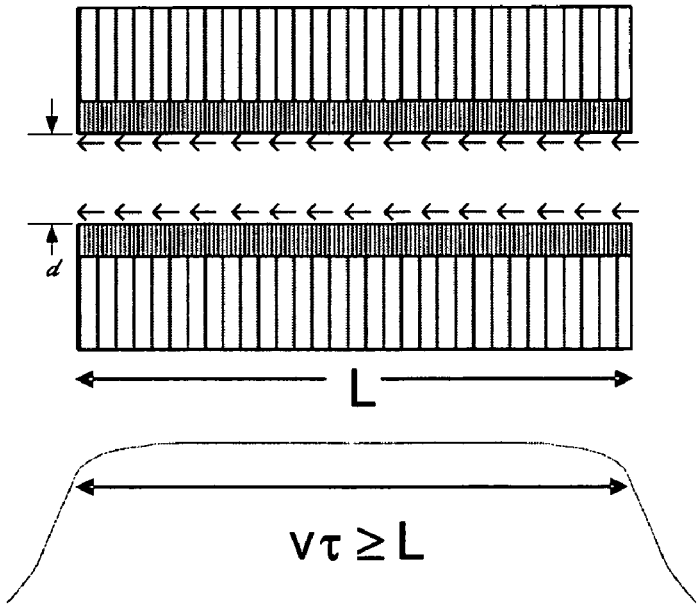
FIG. 27 is a schematic view illustrating a long pulse operation of a typical cell of a conventional dielectric wall accelerator.

FIGS. 26 and 27 illustrate the different in the gradient generated in the beam tube of length L. FIG. 26 shows the single pulse traveling wave having a width vτ less than the length L. In contrast, FIG. 27 shows a typical operation of stacked Blumlein modules where all the transmission lines are simultaneously triggered to produce a gradient across the entire length L of the accelerator. In this case, vτ is greater than or equal to length L.

C. Charged Particle Generator

Integrated Pulsed Ion Source and Injector

Figure 13:
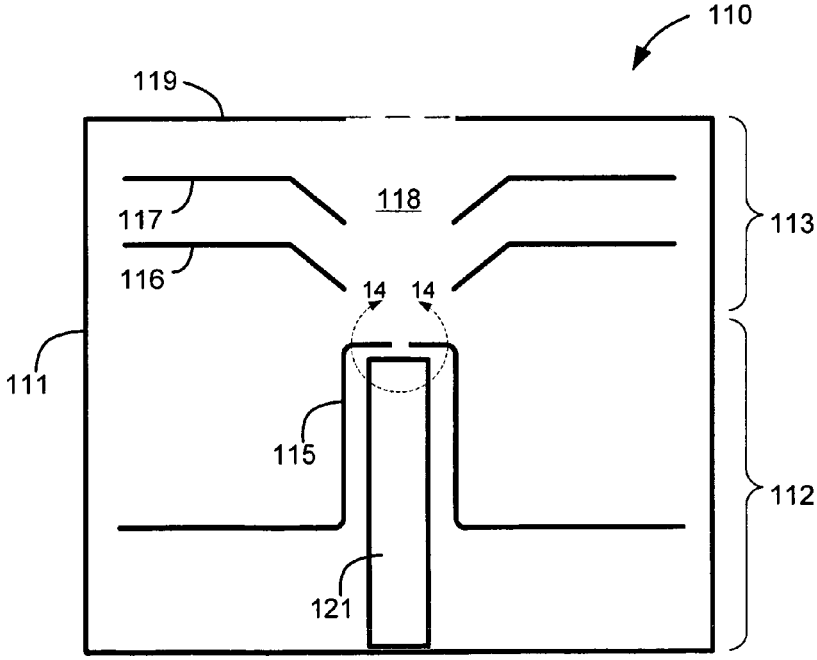
FIG. 13 is schematic view of an exemplary embodiment of the charged particle generator of the present invention.

FIG. 13 shows an exemplary embodiment of a charged particle generator 110 of the present invention, having a pulsed ion source 112 and an injector 113 integrated into a single unit. In order to produce an intense pulsed ion beam modulation of the extracted beam and subsequent bunching is required. First, the particle generator operates to create an intense pulsed ion beam by using a pulsed ion source 112 using a surface flashover discharge to produces a very dense plasma. Estimates of the plasma density are in excess of 7 atmospheres, and such discharges are prompt so as to allow creation of extremely short pulses. Conventional ion sources create a plasma discharge from a low pressure gas within a volume. From this volume, ions are extracted and collimated for acceleration into an accelerator. These systems are generally limited to extracted current densities of below 0.25 A/cm2. This low current density is partially due to the intensity of the plasma discharge at the extraction interface.

Figure 14:
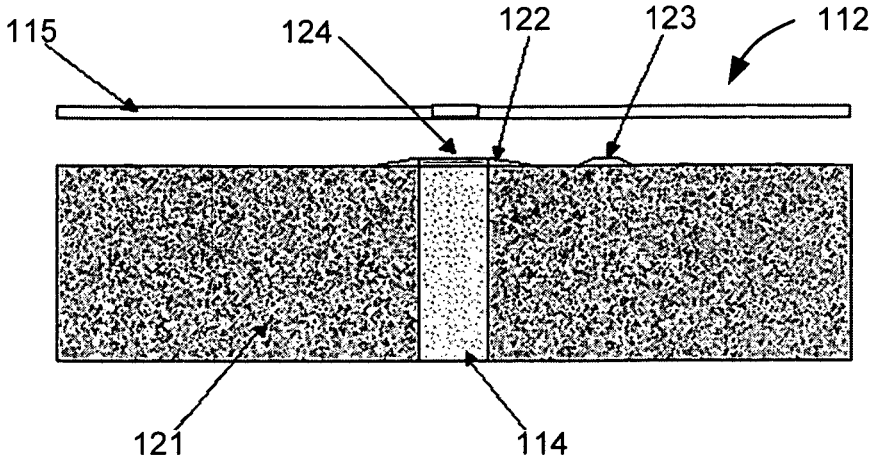
FIG. 14 is an enlarged schematic view taken along circle 14 of FIG. 13, showing an exemplary embodiment of the pulsed ion source of the present invention.
Figure 15:
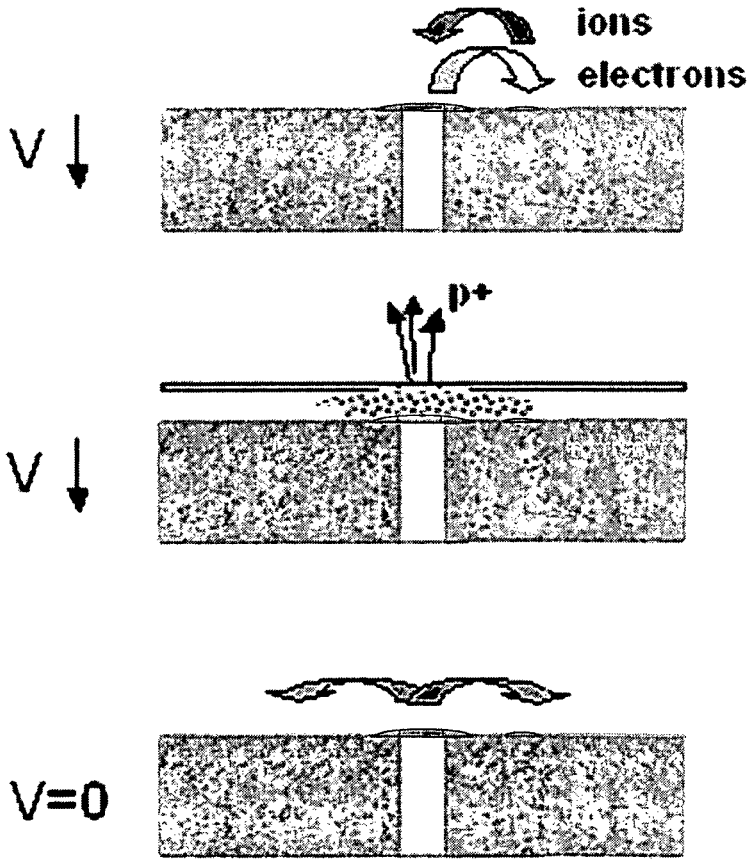
FIG. 15 shows a progression of pulsed ion generation by the pulsed ion source of FIG. 14.

The pulsed ion source of the present invention has at least two electrodes which are bridged with an insulator. The gas species of interest is either dissolved within the metal electrodes or in a solid form between two electrodes. This geometry causes the spark created over the insulator to received that substance into the discharge and become ionized for extraction into a beam. Preferably the at least two electrodes are bridged with an insulating, semi-insulating, or semi-conductive material by which a spark discharge is formed between these two electrodes. The material containing the desired ion species in atomic or molecular form in or in the vicinity of the electrodes. Preferably the material containing the desired ion species is an isotope of hydrogen, e.g. H2, or carbon. Furthermore, preferably at least one of the electrodes is semi-porous and a reservoir containing the desired ion species in atomic or molecular form is beneath that electrode. FIGS. 14 and 15 shows an exemplary embodiment of the pulsed ion source, generally indicated at reference character 112. A ceramic 121 is shown having a cathode 124 and an anode 123 on a surface of the ceramic. The cathode is shown surrounding a palladium centerpiece 124 which caps an H2 reservoir 114 below it. It is appreciated that the cathode and anode may be reversed. And an aperture plate, i.e. gated electrode 115 is positioned with the aperture aligned with the palladium top hat 124.

As shown in FIG. 15, high voltage is applied between the cathode and anode electrode to produce electron emissison. As these electrodes are in near vacuum conditions initially, at a sufficiently high voltage, electrons are field emitted from the cathode. These electrons traverse the space to the anode and upon impacting the anode cause localized heating. This heating releases molecules that are subsequently impacted by the electrons, causing them to become ionized. These molecules may or may not be of the desired species. The ionized gas molecules (ions) accelerate back to the cathode and impact, in this case, a Pd Top Hat and cause heating. Pd has the property, when heated, will allow gas, most notably hydrogen, to permeate through the material. Thus, as the heating by the ions is sufficient to cause the hydrogen gas to leak locally into the volume, those leaked molecules are ionized by the electrons and form a plasma. And as the plasma builds up to sufficient density, a self-sustaining arc forms. Thus, a pulsed negatively charged electrode placed on the opposite of the aperture plate can be used to extract the ions and inject them into the accelerator. In the absence of an extractor electrode, an electric field of the proper polarity can be likewise used to extract the ions. And upon cessation of the arc, the gas deionizes. If the electrodes are made of a gettering material, the gas is absorbed into the metal electrodes to be subsequently used for the next cycle. Gas which is not reabsorbed is pumped out by the vacuum system. The advantage of this type of source is that the gas load on the vacuum system is minimized in pulsed applications.

Charged particle extraction, focusing and transport from the pulsed ion source 112 to the input of a linear accelerator is provided by an integrated injector section 113, shown in FIG. 13. In particular, the injector section 113 of the charged particle generator serves to also focus the charged-ion beam onto the target, which can be either a patient in a charged-particle therapy facility or a target for isotope generation or any other appropriate target for the charge-particle beam. Furthermore, the integrated injector of the present invention enables the charged particle generator to use only electric focusing fields for transporting the beam and focusing on the patient. There are no magnets in the system. The system can deliver a wide range of beam currents, energies and spot sizes independently.

Figure 16:
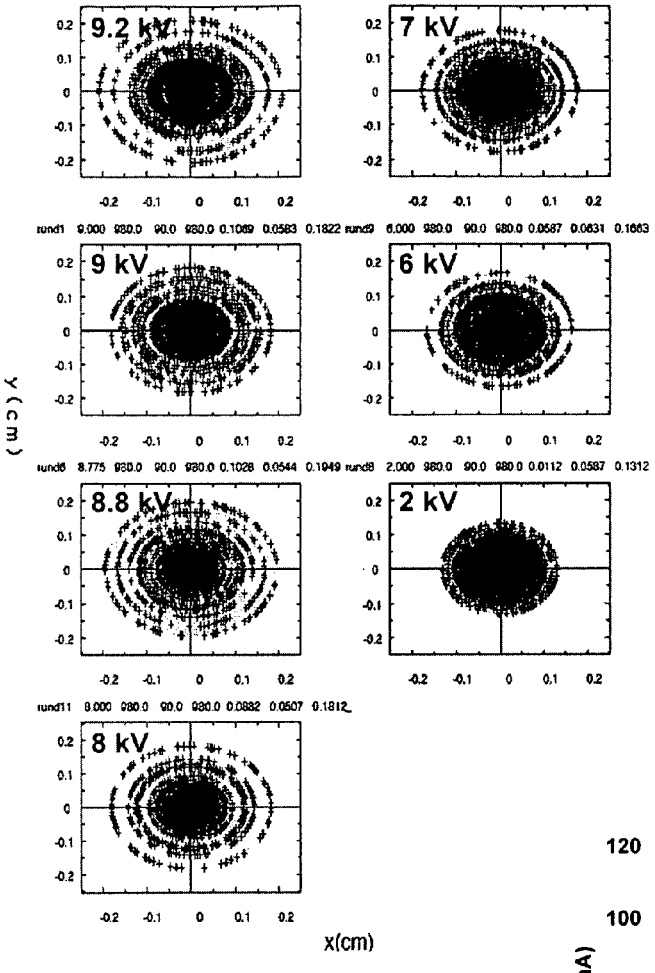
FIG. 16 shows multiple screen shots of final spot sizes on the target for various gate electrode voltages.
Figure 17:
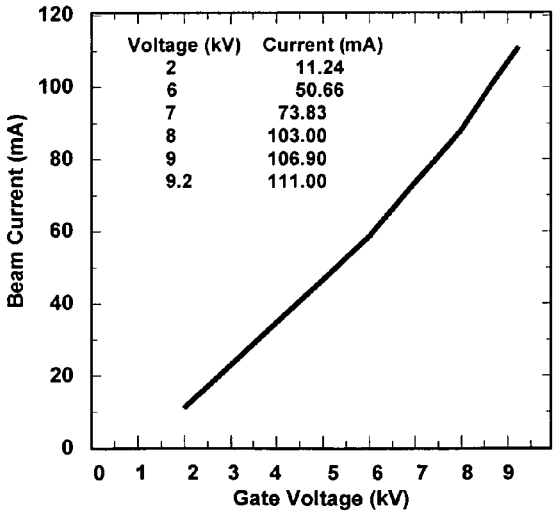
FIG. 17 shows a graph of extracted proton beam current as a function of the gate electrode voltage on a high-gradient proton beam accelerator.
Figure 18:
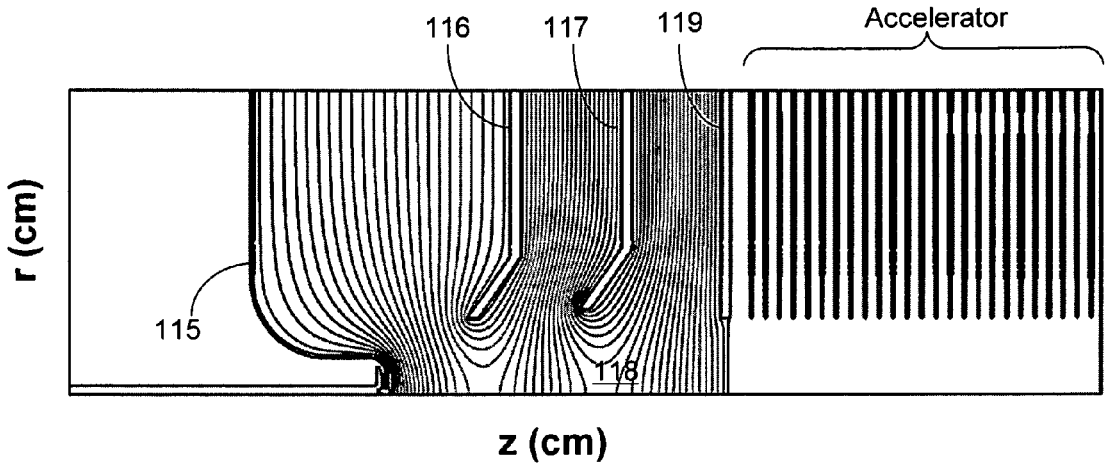
FIG. 18 shows two graphs showing potential contours in the charged particle generator of the present invention.
Figure 18:
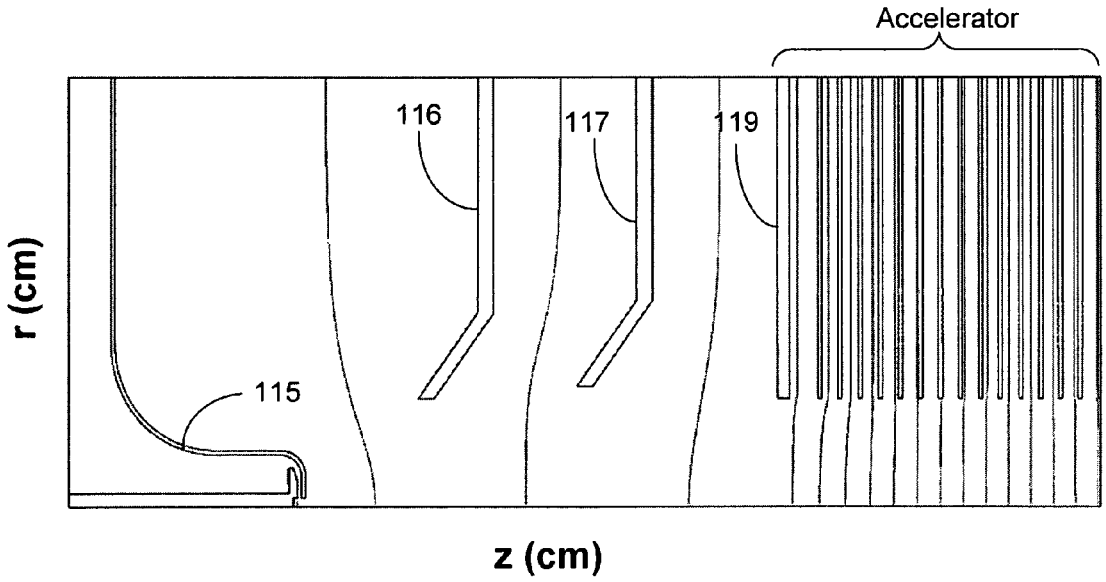
Figure 21:
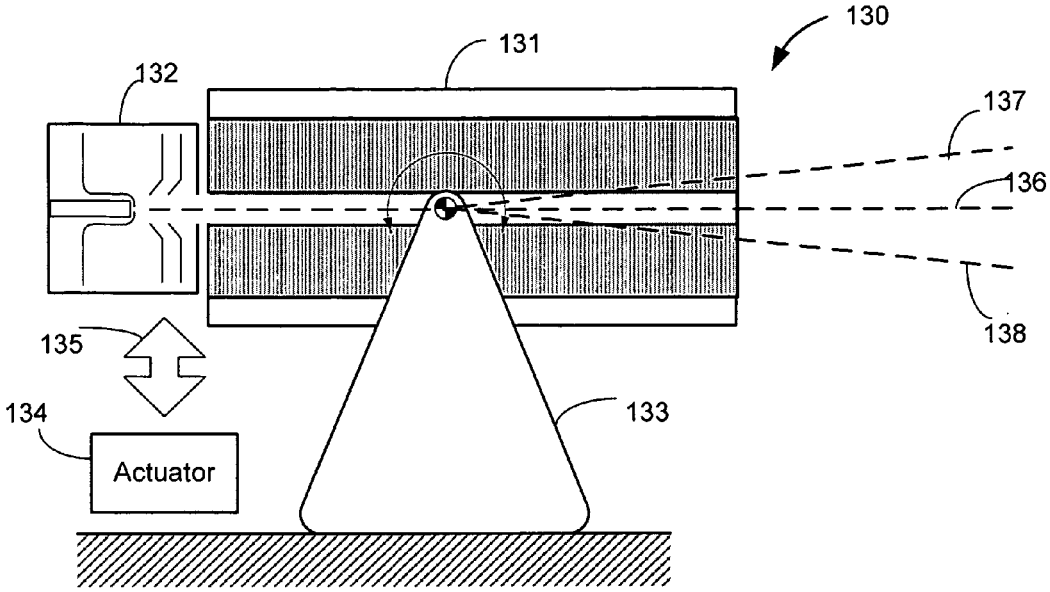
FIG. 21 is a schematic view of the actuable compact accelerator system of the present invention having an integrated unitary charged particle generator and linear accelerator.

FIG. 13 shows a schematic arrangement of the injector 113 in relation to the pulsed ion source 112, and FIG. 21 shows a schematic of the combined charged particle generator 132 integrated with a linear accelerator 131. The entire compact high-gradient accelerator's beam extraction, transport and focus are controlled by the injector comprising a gate electrode 115, an extraction electrode 116, a focus electrode 117, and a grid electrode 119, which locate between the charge particle source and the high-gradient accelerator. It is notable, however, that the minimum transport system should consist of an extraction electrode, a focusing electrode and the grid electrode. And more than one electrode for each function can be used if they are needed. All the electrodes can also be shaped to optimize the performance of the system, as shown in FIG. 18. The gate electrode 115 with a fast pulsing voltage is used to turn the charged particle beam on and off within a few nanoseconds. The simulated extracted beam current as a function of the gate voltage in a high-gradient accelerator designed for proton therapy is presented in FIG. 17, and the final beam spots for various gate voltages are presented in FIG. 16. In simulations performed by the inventors, the nominal gate electrode's voltage is 9 kV, the extraction electrode is at 980 kV, the focus electrode is at 90 kV, the grid electrode is at 980 kV, and the high-gradient accelerator is acceleration gradient is 100 MV/m. Since FIG. 16 shows that the final spot size is not sensitive to the gate electrode's voltage setting, the gate voltage provides an easy knob to turn on/off the beam current as indicated by FIG. 17.

The high-gradient accelerator system's injector uses a gate electrode and an extraction electrode to extract and catch the space charge dominated beam, whose current is determined by the voltage on the extraction electrode. The accelerator system uses a set of at least one focus electrodes 117 to focus the beam onto the target. The potential contour plots shown in FIG. 18, illustrate how the extraction electrodes and the focus electrodes function. The minimum focusing/transport system, i.e., one extraction electrode and one focus electrode, is used in this case. The voltages on the extraction electrode, the focus electrode and the grid electrode at the high-gradient accelerator entrance are 980 kV, 90 kV and 980 kV. FIG. 18 shows that the shaped extraction electrode voltage sets the gap voltage between the gate electrode and the extraction electrode. FIG. 18 also shows that the voltages on the shaped extraction electrode, the shaped focusing electrode and the grid electrodes create an electrostatic focusing-defocusing-focusing region, i.e., an Einzel lens, which provides a strong net focusing force on the charge particle beam.

Although using Einzel lens to focus beam is not new, the accelerator system of the present invention is totally free of focusing magnets. Furthermore, the present invention also combines Einzel lens with other electrodes to allow the beam spot size at the target tunable and independent of the beam's current and energy. At the exit of the injector or the entrance of our high-gradient accelerator, there is the grid electrode 119. The extraction electrode and the grid electrode will be set at the same voltage. By having the grid electrode's voltage the same as the extraction electrode's voltage, the energy of the beam injected into the accelerator will stay the same regardless of the voltage setting on the shaped focus electrode. Hence, changing the voltage on the shaped focus electrode will only modify the strength of the Einzel lens but not the beam energy. Since the beam current is determined by the extraction electrode's voltage, the final spot can be tuned freely by adjusting the shaped focus electrode's voltage, which is independent of the beam current and energy. In such a system, it is also appreciated that additional focusing results from a proper gradient (i.e. $dE_z/dz$) in the axial electric field and additionally as a result in the time rate of change of the electric field (i.e. dE/dt at $z=z_0$).

Figure 19:
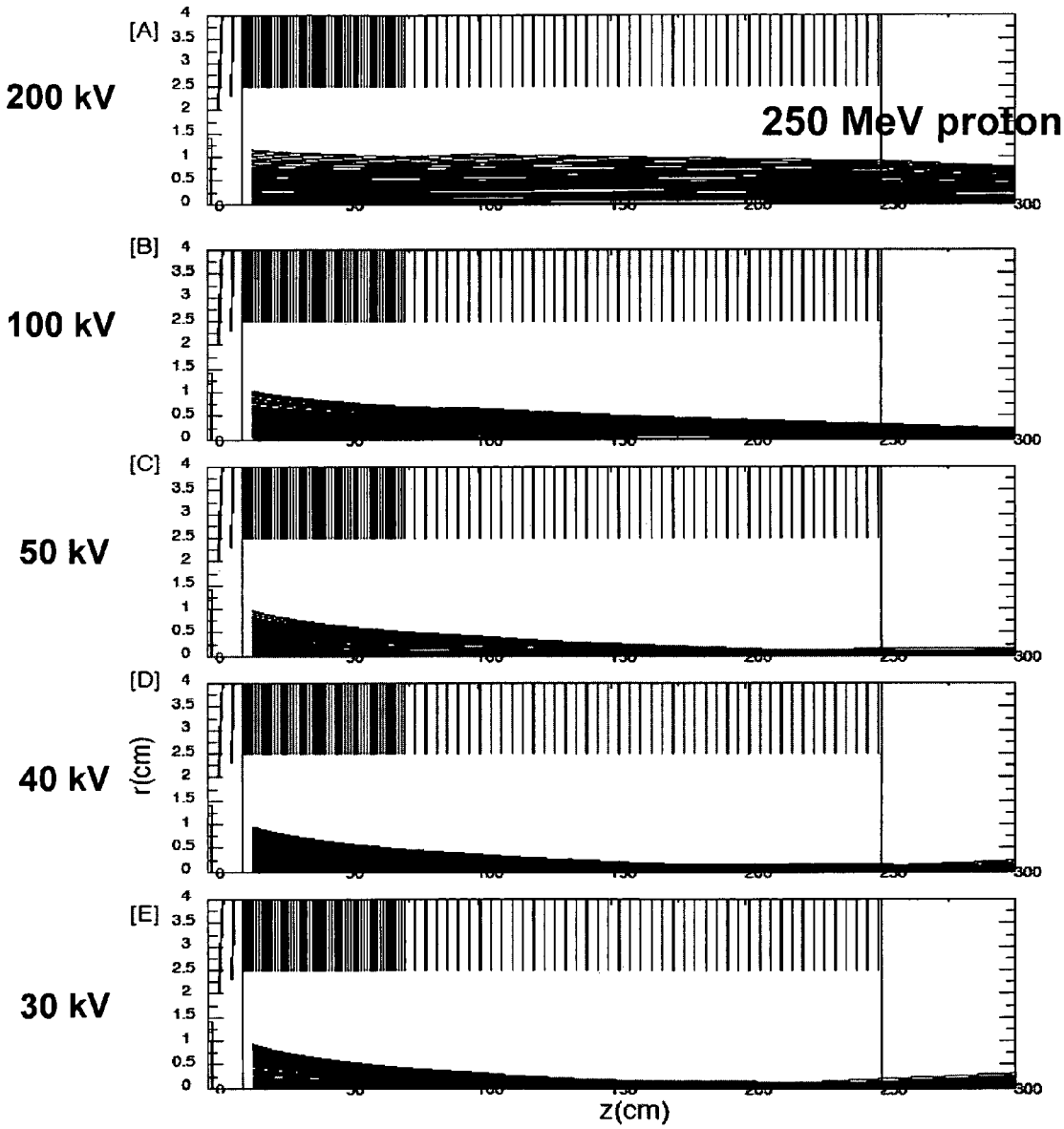
FIG. 19 is a comparative view of beam transport in a magnet-free 250 MeV high-gradient proton accelerator with various focus electrode voltage settings.
Figure 20:
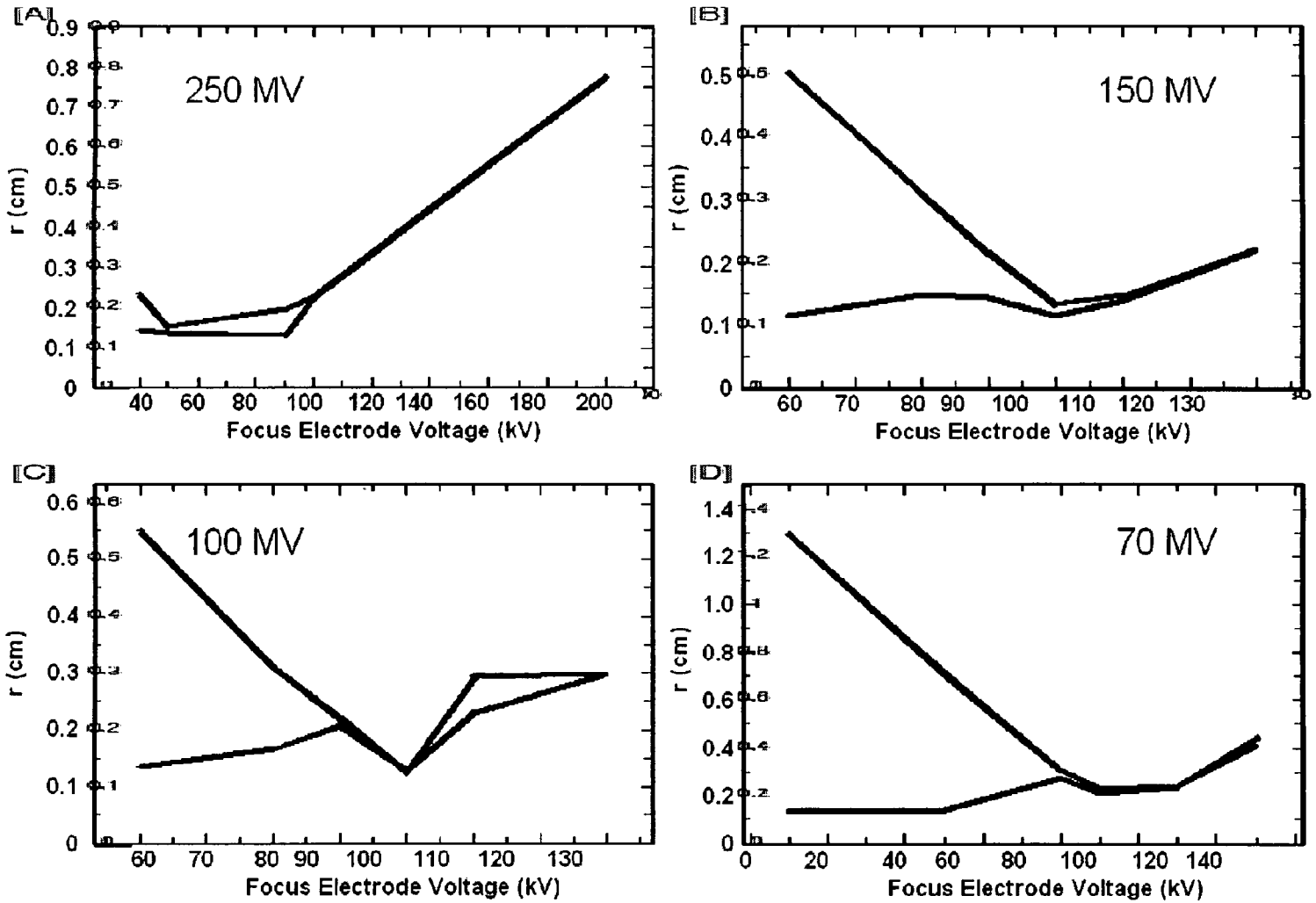
FIG. 20 is a comparative view of four graphs of the edge beam radii (upper curves) and the core radii (lower curves) on the target versus the focus electrode voltage for 250 MeV, 150 MeV, 100 MeV, and 70 MeV proton beams.

Simulated beam envelopes for beam transport through a magnet-free 250-MeV proton high-gradient accelerator with various focus electrode voltage setting is presented in FIG. 19. With their corresponding focus electrode voltages given at the left, these plots clearly show that the spot size of the 250-MeV proton beam on the target can easily be tuned by adjusting the focus electrode voltage. And plots of spot sizes versus the focus electrode voltage for various proton beam energies are shown in FIG. 20. Two curves are plotted for each proton energy. The upper curves present the edge radii of the beam, and the lower curves present the core radii. These plots show that a wide range of spot sizes (2 mm-2 cm diameter) can be obtained for the 70-250 MeV, 100-mA proton beam by adjusting the focus electrode voltage on a high-gradient proton therapy accelerator with an accelerating gradient of 100-MV.

The compact high-gradient accelerator system employing such an integrated charged particle generator can deliver a wide range of beam currents, energies and spot sizes independently. The entire accelerator's beam extraction, transport and focus are controlled by a gate electrode, a shaped extraction electrode, a shaped focus electrode and a grid electrode, which locate between the charge particle source and the high-gradient accelerator. The extraction electrode and the grid electrode have the same voltage setting. The shaped focus electrode between them is set at a lower voltage, which forms an Einzel lens and provides the tuning knob for the spot size. While the minimum transport system consists of an extraction electrode, a focusing electrode and the grid electrode, more Einzel lens with alternating voltages can be added between the shaped focus electrode and the grid electrode if a system needs really strong focusing force.

D. Actuable Compact Accelerator System for Medical Therapy

FIG. 21 shows a schematic view of an exemplary actuable compact accelerator system 130 of the present invention having a charged particle generator 132 integrally mounted or otherwise located at an input end of a compact linear accelerator 131 to form a charged particle beam and to inject the beam into the compact accelerator along the acceleration axis. By integrating the charged particle generator to the acceleration in this manner, a relatively compact size with unit construction may be achieved capable of unitary actuation by an actuator mechanism 134, as indicated by arrow 135, and beams 136-138. In previous systems, because of their scale size, magnets were required to transport a beam from a remote location. In contrast, because the scale size is significantly reduced in the present invention, a beam such as a proton beam may be generated, controlled, and transported all in close proximity to the desired target location, and without the use of magnets. Such a compact system would be ideal for use in medical therapy accelerator applications, for example.

Figure 22:
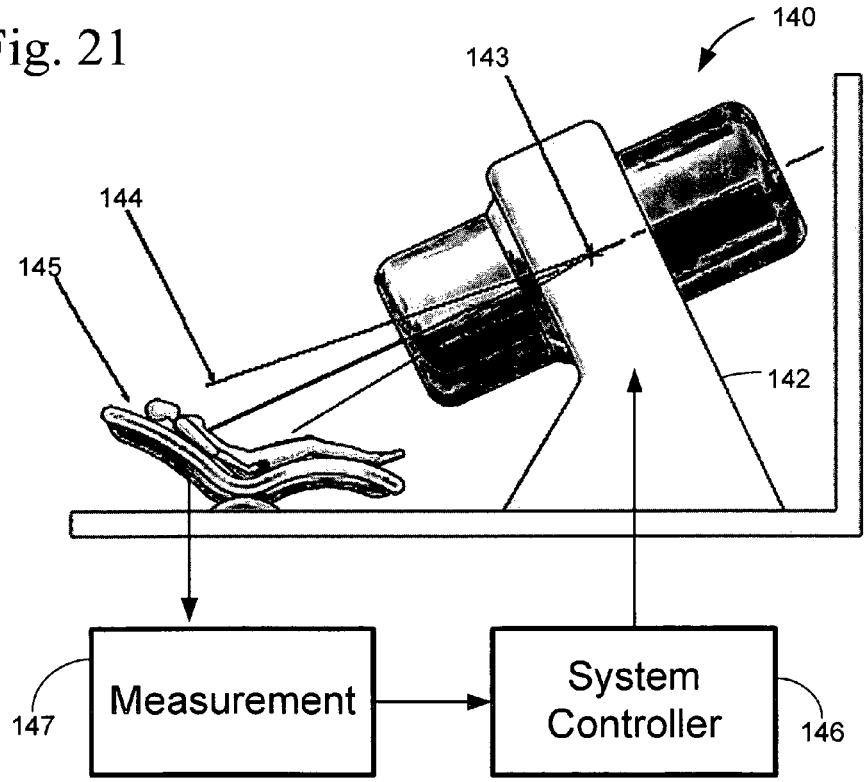
FIG. 22 is a side view of an exemplary mounting arrangement of the unitary compact accelerator/charged particle source of the present invention, illustrating a medical therapy application.
Figure 24:
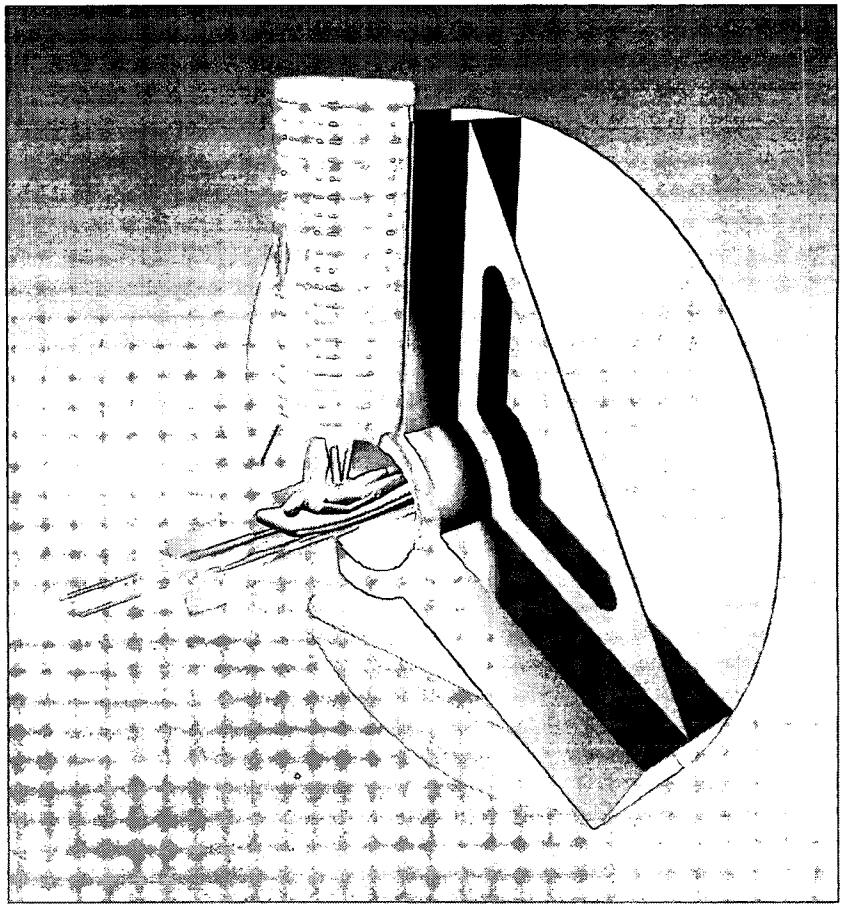
FIG. 24 is a perspective view of an exemplary hub-spoke mounting arrangement of the unitary compact accelerator/charged particle source of the present invention.
Figure 23:
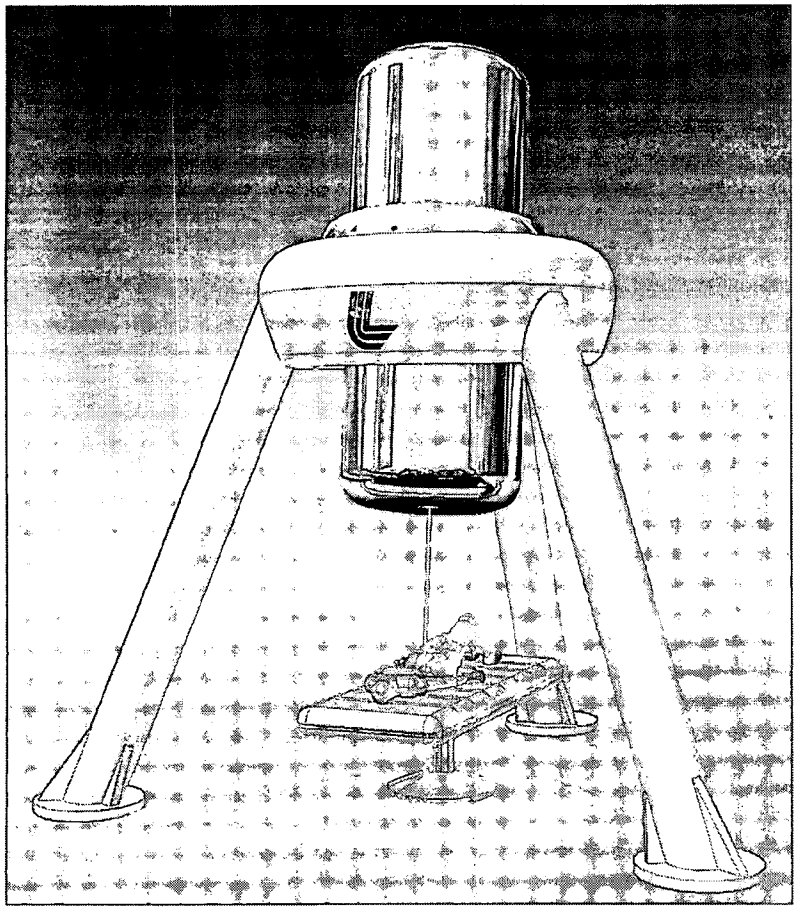
FIG. 23 is a perspective view of an exemplary vertical mounting arrangement of the unitary compact accelerator/charged particle source of the present invention.

Such a unitary apparatus may be mounted on a support structure, generally shown at 133, which is configured to actuate the integrated particle. generator-linear accelerator to directly control the position of a charged particle beam and beam spot created thereby. Various configurations for mounting the unitary combination of compact accelerator and charge particle source are shown in FIGS. 22-24, but is not limited to such. In particular, FIGS. 22-24 show exemplary embodiments of the present invention showing a combined compact accelerator/charged particle source mounted on various types of support structure, so as to be actuable for controlling beam pointing. The accelerator and charged particle source may be suspended and articulated from a fixed stand and directed to the patient (FIGS. 22 and 23). In FIG. 22, unitary actuation is possible by rotating the unit apparatus about the center of gravity indicated at 143. As shown in FIG. 22, the integrated compact generator-accelerator may be preferably pivotally actuated about its center of gravity to reduce the energy required to point the accelerated beam. It is appreciated, however, that other mounting configurations and support structures are possible within the scope of the present invention for actuating such a compact and unitary combination of compact accelerator and charged particle source.

It is appreciated that various accelerator architectures may be used for integration with the charged particle generator which enables the compact actuable structure. For example, accelerator architecture may employ two transmission lines in a Blumlein module construction previously described. Preferably the transmission lines are parallel plate transmission lines. Furthermore, the transmission lines preferably have a strip-shaped configuration as shown in FIGS. 1-12. Also, various types of high-voltage switches with fast (nanosecond) close times may be used, such as for example, SiC photoconductive switches, gas switches, or oil switches.

And various actuator mechanisms and system control methods known in the art may be used for controlling actuation and operation of the accelerator system. For example, simple ball screws, stepper motors, solenoids, electrically activated translators and/or pneumatics, etc. may be used to control accelerator beam positioning and motion. This allows programming of the beam path to be very similar if not identical to programming language universally used in CNC equipment. It is appreciated that the actuator mechanism functions to put the integrated particle generator-accelerator into mechanical action or motion so as to control the accelerated beam direction and beamspot position. In this regard, the system has at least one degree of rotational freedom (e.g. for pivoting about a center of mass), but preferably has six degrees of freedom (DOF) which is the set of independent displacement that specify completely the displaced or deformed position of the body or system, including three translations and three rotations, as known in the art. The translations represent the ability to move in each of three dimensions, while the rotations represent the ability to change angle around the three perpendicular axes.

Accuracy of the accelerated beam parameters can be controlled by an active locating, monitoring, and feedback positioning system (e.g. a monitor located on the patient 145) designed into the control and pointing system of the accelerator, as represented by measurement box 147 in FIG. 22. And a system controller 146 is shown controlling the accelerator system, which may be based on at least one of the following parameters of beam direction, beamspot position, beamspot size, dose, beam intensity, and beam energy. Depth is controlled relatively precisely by energy based on the Bragg peak. The system controller preferably also includes a feedforward system for monitoring and providing feedforward data on at least one of the parameters. And the beam created by the charged particle and accelerator may be configured to generate an oscillatory projection on the patient. Preferably, in one embodiment, the oscillatory projection is a circle with a continuously varying radius. In any case, the application of the beam may be actively controlled based on one or a combination of the following: position, dose, spotsize, beam intensity, beam energy.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. A compact accelerator system comprising:

a support structure;

an integrated particle generator-accelerator actuably mounted on the support structure, comprising: a compact linear accelerator having at least one transmission line(s) extending toward a transverse acceleration axis; and a charged particle generator connected to the compact linear accelerator for producing and injecting a charged particle beam into the compact linear accelerator along the acceleration axis;

switch means connectable to a high voltage potential for propagating at least one electrical wavefront(s) through the transmission line(s) of the compact linear accelerator to impress a pulsed gradient along the acceleration axis which imparts energy to the injected beam; and means for actuating the integrated particle generator-accelerator to control the pointing direction of the energized beam and the position of the beamspot produced thereby;

wherein the means for actuating the integrated particle generator-accelerator comprises at least one actuator mechanism capable of effecting displacement of the integrated particle generator-accelerator, and a system controller for controlling the actuator mechanism.

2. The compact accelerator system as in claim 1, wherein the integrated particle generator-accelerator is mounted to enable pivotal actuation about its center of mass.

3. The compact accelerator system as in claim 1, wherein the support structure includes a rotatable hub and the integrated particle generator-accelerator is radially mounted as a spoke on the hub.

4. The compact accelerator system as in claim 1, wherein the system controller is adapted to control the actuator mechanism(s), the energized beam, and the beamspot based on at least one of the parameters of beam direction, beamspot position, beamspot size, dose, beam intensity, and beam energy.

5. The compact accelerator system as in claim 4, wherein the system controller includes a feedforward system for monitoring and providing feedforward data on at least one of the parameters.

6. The compact accelerator system as in claim 4, wherein the system controller includes a feedback system for monitoring and providing feedback data on at least one of the parameters.

7. The compact accelerator system as in claim 1, wherein the charged particle generator comprises a pulsed ion source having at least two electrodes bridged by a bridging material selected from the group consisting of insulating, semi-insulating, and semi-conductive materials, and a source material having a desired ion species in atomic or molecular form located adjacent at least one of the electrodes.

8. The compact accelerator system as in claim 7, wherein the source material is located adjacent the cathode.

9. The compact accelerator system as in claim 7, wherein at least one of the electrodes is semi-porous and the source material is located in the bridging material beneath the semi-porous electrode.

10. The compact accelerator system as in claim 7, wherein the desired ion species is an isotope selected from the group consisting of hydrogen and carbon.

11. The compact accelerator system as in claim 7, wherein the charged particle generator further comprises at least one extraction electrode whose voltage determines the current of the charged particle beam, at least one focus electrode, and at least one grid electrode, all serially arranged along the acceleration axis between the pulsed ion source and the input end of the compact linear accelerator, for extracting, focusing, and injecting the charged particle beam from the pulsed ion source into the input end of the compact linear accelerator without the use of focusing magnets.

12. The compact accelerator system as in claim 11, wherein the respective voltages of the extraction, focus, and grid electrodes are high, low, and high, relative to each other, to form an electrostatic focusing-defocusing-focusing region of an Einzel lens prior to entry into the compact linear accelerator.

13. The compact accelerator system as in claim 12, wherein the voltages of the extraction and grid electrodes are the same so that the energy of the injected charged particle beam remains the same independent of the focus electrode voltage.

14. The compact accelerator system as in claim 12, wherein the system controller includes means for variably controlling the voltage of the focus electrode to modify the strength of the Einzel lens and control the beamspot size thereby.

15. The compact accelerator system as in claim 12, wherein the extraction, focus, and grid electrodes are shaped to tune the electrostatic focusing-defocusing-focusing region of the Einzel lens.

16. The compact accelerator system as in claim 11, wherein the charged particle generator further comprises a gate electrode between the pulsed ion source and the extraction electrode for gating the charged particle beam from the pulsed ion source.

17. The compact accelerator system as in claim 1, wherein the switch means is a plurality of SiC photoconductive switches.

18. The compact accelerator system as in claim 1, wherein the switch means is a plurality of gas switches.

19. The compact accelerator system as in claim 1, wherein the switch means is a plurality of oil switches.

20. The compact accelerator system as in claim 1, wherein the compact accelerator comprises at least one Blumlein module(s) having two transmission lines, each Blumlein module comprising:

a first conductor having a first end, and a second end adjacent the acceleration axis;

a second conductor adjacent to the first conductor, said second conductor having a first end switchable to the high voltage potential, and a second end adjacent the acceleration axis;

a third conductor adjacent to the second conductor, said third conductor having a first end, and a second end adjacent the acceleration axis;

a first dielectric material with a first dielectric constant that fills the space between the first and second conductors; and a second dielectric material with a second dielectric constant that fills the space between the second and third conductors.

21. The compact accelerator system as in claim 20, wherein the first, second, and third conductors and the first and second dielectric materials have parallel-plate strip configurations extending from the first to second ends.

22. The compact accelerator system as in claim 20, wherein the compact linear accelerator includes a dielectric sleeve surrounding the acceleration axis adjacent the second ends of the Blumlein module(s), said dielectric sleeve having a dielectric constant greater than the first and second dielectric materials of the Blumlein module(s).

23. The compact accelerator system as in claim 22, wherein the dielectric sleeve comprises alternating layers of conductors and dielectrics in planes orthogonal to the acceleration axis.

24. The compact accelerator system as in claim 20, further comprising means for sequentially controlling the switch means of the symmetric Blumlein so that a traveling axial electric field is produced along a beam tube surrounding the acceleration axis in synchronism with an axially traversing pulsed beam of charged particles to serially impart energy to said particles.

25. The compact accelerator system as in claim 24, wherein the means for sequentially controlling the switch means is capable of simultaneously switching at least two adjacent pulse-forming transmission lines which form a block and sequentially switching adjacent blocks, so that an acceleration pulse is formed through each block.

26. The compact accelerator system as in claim 24, wherein the diameter d and length l of the beam tube satisfy the criteria $l>4d$, so as to reduce fringe fields at the input and output ends of the dielectric beam tube.

27. The compact accelerator system as in claim 24, wherein the beam tube satisfies the criteria: $\gamma\tau v>d/0.6$, where v is the velocity of the wave on the beam tube wall, d is the diameter of the beam tube, $\tau$ is the pulse width where $$\tau = \frac{2\Delta R\sqrt{\mu_r\varepsilon_r}}{c},$$

and $\gamma$ is the Lorentz factor where $$\gamma = \frac{1}{\sqrt{1-\frac{v^2}{c^2}}}.$$

28. The compact accelerator system as in claim 1, wherein the pulsed high gradient produced along the acceleration axis is at least about 30 MeV per meter.

29. The compact accelerator system as in claim 28, wherein the pulsed high gradient produced along the acceleration axis is up to about 150 MeV per meter.

* * * * *